US009437131B2

(12) United States Patent
Nagara

(10) Patent No.: US 9,437,131 B2
(45) Date of Patent: Sep. 6, 2016

(54) DRIVING A MULTI-LAYER TRANSPARENT DISPLAY

(71) Applicant: Wes A. Nagara, Commerce Township, MI (US)

(72) Inventor: Wes A. Nagara, Commerce Township, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 0 days.

(21) Appl. No.: 14/282,844

(22) Filed: May 20, 2014

(65) Prior Publication Data

US 2015/0009189 A1 Jan. 8, 2015

Related U.S. Application Data

(60) Provisional application No. 61/843,179, filed on Jul. 5, 2013.

(51) Int. Cl.

| | |
|---|---|
| ***G09G 3/30*** | (2006.01) |
| ***G09G 3/32*** | (2016.01) |
| ***G09G 3/00*** | (2006.01) |

(52) U.S. Cl.

CPC ..... *G09G 3/32* (2013.01); *G09G 3/003* (2013.01); *G09G 2300/023* (2013.01); *G09G 2340/12* (2013.01); *G09G 2360/04* (2013.01); *G09G 2380/10* (2013.01)

(58) Field of Classification Search

CPC ..... G09G 2300/023; G09G 2380/10
USPC ..... 354/4
See application file for complete search history.

(56) References Cited

U.S. PATENT DOCUMENTS

| | | | | |
|---|---|---|---|---|
| 6,275,236 | B1 * | 8/2001 | Delahunty | G01S 7/064 345/30 |
| 6,661,425 | B1 * | 12/2003 | Hiroaki | G09G 3/003 345/1.1 |
| 8,050,499 | B2 * | 11/2011 | Kanatsu | G06K 9/00456 382/173 |
| 8,248,462 | B2 | 8/2012 | Peterka et al. | |
| 8,416,149 | B2 | 4/2013 | Evanicky | |
| 8,416,150 | B2 | 4/2013 | Paul et al. | |
| 2004/0183659 | A1 * | 9/2004 | Somuah | B60Q 1/503 340/435 |
| 2006/0098029 | A1 * | 5/2006 | Clas | G06T 15/503 345/629 |
| 2006/0125745 | A1 * | 6/2006 | Evanicky | 345/84 |
| 2007/0150906 | A1 * | 6/2007 | Richards et al. | 719/328 |
| 2007/0230810 | A1 * | 10/2007 | Kanatsu | G06K 9/00456 382/243 |
| 2007/0252804 | A1 * | 11/2007 | Engel et al. | 345/98 |

(Continued)

FOREIGN PATENT DOCUMENTS

| | | | |
|---|---|---|---|
| AU | 2012230088 | A1 | 4/2013 |
| CN | 103051711 | A | 4/2013 |
| EP | 1465126 | A2 | 10/2004 |

*Primary Examiner* — Gene W Lee
(74) *Attorney, Agent, or Firm* — Dickinson Wright PLLC

(57) ABSTRACT

A system and method for driving a multi-layer transparent display, the multi-transparent display including a first transparent display layer and a second transparent display layer is provided. The system includes an input module to receive a stimulus to present content via the multi-transparent display; a display module to determine whether the content is presented via the first transparent display layer or the second transparent display layer; and a layer driver to determine, in response to a condition, whether the content is displayed via the first transparent display layer or the second transparent display layer.

8 Claims, 5 Drawing Sheets

(56) References Cited

U.S. PATENT DOCUMENTS

2009/0189753 A1* 7/2009 Enya ..... G02B 27/01 340/435
2009/0306885 A1* 12/2009 Yokoyama ..... G01C 21/3664 701/532
2010/0057566 A1* 3/2010 Itzhak ..... G06F 17/30873 705/14.53
2011/0257973 A1* 10/2011 Chutorash ..... G01C 21/3661 704/235
2011/0291918 A1* 12/2011 Surber ..... F41H 5/0407 345/8
2011/0310121 A1* 12/2011 Baron ..... G09G 3/003 345/634
2011/0317002 A1* 12/2011 Muresan ..... H04N 7/18 348/115
2012/0265416 A1* 10/2012 Lu ..... B60R 1/00 701/70
2012/0327082 A1 12/2012 Kim et al.
2013/0084991 A1 4/2013 LeMay et al.
2013/0104061 A1 4/2013 Engel et al.
2013/0194167 A1* 8/2013 Yun ..... G09G 5/003 345/84
2013/0342696 A1* 12/2013 Cai ..... H04N 7/18 348/148
2014/0035942 A1* 2/2014 Yun ..... G09G 5/006 345/592
2014/0092250 A1* 4/2014 Nagasawa ..... G01C 21/3602 348/148
2014/0192281 A1* 7/2014 Smithwick ..... G02F 1/1313 349/15
2014/0282182 A1* 9/2014 Yamada ..... B60K 37/02 715/771
2014/0292805 A1* 10/2014 Yamada ..... G09G 5/377 345/629
2015/0279260 A1* 10/2015 Katagiri ..... B60K 35/00 345/590
2015/0314789 A1* 11/2015 Roos ..... B60W 50/14 701/123

* cited by examiner

DRIVING A MULTI-LAYER TRANSPARENT DISPLAY

CROSS REFERENCE TO RELATED APPLICATIONS

This U.S. Patent Application claims the benefit of U.S. Provisional Patent Application Ser. No. 61/843,179 filed Jul. 5, 2013, entitled "Driving A Multi-Layer Transparent Display," the entire disclosure of the application being considered part of the disclosure of this application and hereby incorporated by reference.

BACKGROUND

Transparent displays, such as a transparent light emitting display (LED), may be provided to augment pre-existing display units. The transparent display allows a viewer to see through the transparent display simultaneously while being presented information being presented on the display.

The transparent display may be implemented in a vehicle. The vehicle is ideal for a transparent display because the transparent display allows the operator of the vehicle to view mechanical elements to the rear of display (ex. gauges) while simultaneously being served information on the transparent display.

The transparent display may convey information, such as information directed to road conditions, weather, vehicle status, and the like. Thus, the operator of the vehicle may rely on the display of the transparent display to safely and efficiently operate the vehicle.

Multiple transparent displays may be provided to further augment an existing display. In addition to providing the multiple transparent displays along with mechanical displays, the multiple transparent displays may be provided as a stand-alone unit.

The multiple transparent displays, when superimposed upon each other, may provide a three-dimensional (3D) effect. In particular, an image may be provided on a first layer and altered slightly on a second layer to produce a combined image. The combined image may appear to the viewer as 3D. Multiple transparent displays may be referred to as multi-layer transparent displays throughout this disclosure.

Thus, by providing the viewer with a 3D image, a multiple transparent display may achieve a more graphically stimulating experience than that a mere two-dimensional (2D) graphical presentation. The 3D combined image may be more robust in alerting the viewer with information associated with the multiple transparent displays.

In certain applications, such as a dashboard display of a vehicle, presenting 3D multi-layer transparent displays may lead to an enhanced user experience. For example, the 3D multi-layer transparent displays may be placed over a mechanical gauge integrated as part of the vehicle. The 3D multi-layer transparent display may cause the mechanical gauge to appear as 3D. This 3D appearance may serve as an enhanced user experience.

SUMMARY

A system and method for driving a multi-layer transparent display, the multi-transparent display including a first transparent display layer and a second transparent display layer is provided. The system includes an input module to receive a stimulus to present content via the multi-transparent display; a display module to determine whether the content is presented via the first transparent display layer or the second transparent display layer; and a layer driver to determine, in response to a condition, whether the content is displayed via the first transparent display layer or the second transparent display layer.

DESCRIPTION OF THE DRAWINGS

The detailed description refers to the following drawings, in which like numerals refer to like items, and in which.

DETAILED DESCRIPTION

Standard, non-transparent displays, may display information to a viewer of the display. However, because the information is presented in a planar fashion, the information may not alert the viewer.

Disclosed herein are methods and systems for driving a multi-layer transparent display. The methods and systems allow an implementer to individual drive each layer of the multi-layer transparent display. Because some information is displayed at a layer closer to the viewer, the methods and systems directed herein may allow the implementer to selectively provide information on the closest layer, or a subsequent layer.

Thus, by allowing the implementer of the methods and systems disclosed herein to individually control each individual layer of the multi-layer transparent display, a powerful user experience may be experienced by the viewer of the multi-layer transparent display. For example, because the multi-layer transparent display is more effective at directing or catching a viewer's attention, in response to the multi-layer transparent display being implemented in a vehicle, a safe vehicle operation may be realized.

Figure 1:
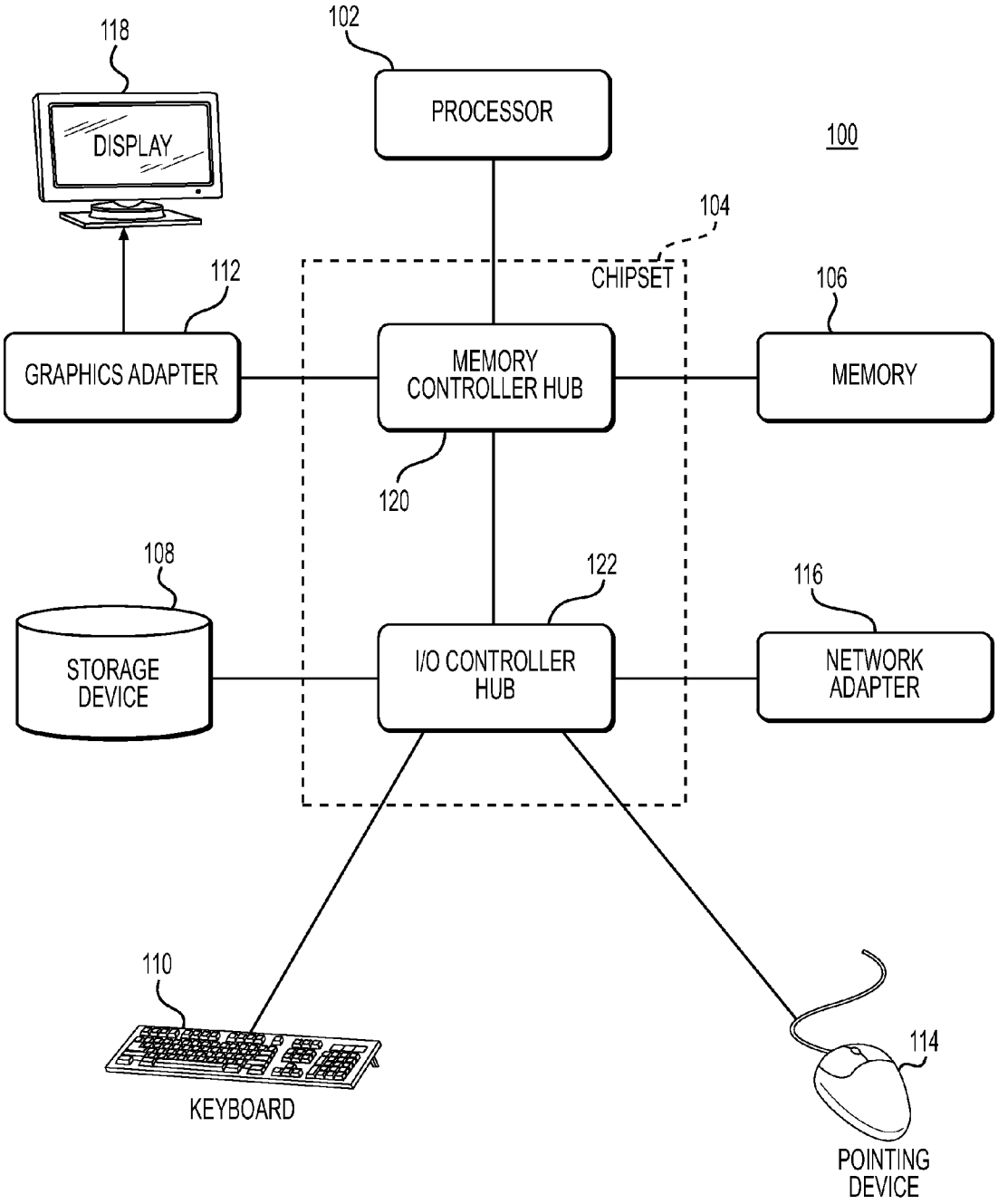
FIG. 1 is a block diagram illustrating an example computer.

FIG. 1 is a block diagram illustrating an example computer 100. The computer 100 includes at least one processor 102 coupled to a chipset 104. The chipset 104 includes a memory controller hub 120 and an input/output (I/O) controller hub 122. A memory 106 and a graphics adapter 112 are coupled to the memory controller hub 120, and a display 118 is coupled to the graphics adapter 112. A storage device 108, keyboard 110, pointing device 114, and network adapter 116 are coupled to the I/O controller hub 122. Other embodiments of the computer 100 may have different architectures.

The storage device 108 is a non-transitory computer-readable storage medium such as a hard drive, compact disk read-only memory (CD-ROM), DVD, or a solid-state memory device. The memory 106 holds instructions and data used by the processor 102. The pointing device 114 is a mouse, track ball, or other type of pointing device, and is used in combination with the keyboard 110 to input data into the computer system 100. The graphics adapter 112 displays images and other information on the display 118. The network adapter 116 couples the computer system 100 to one or more computer networks.

The computer 100 is adapted to execute computer program modules for providing functionality described herein. As used herein, the term "module" refers to computer program logic used to provide the specified functionality. Thus, a module can be implemented in hardware, firmware, and/or software. In one embodiment, program modules are stored on the storage device 108, loaded into the memory 106, and executed by the processor 102.

The types of computers used by the entities and processes disclosed herein can vary depending upon the embodiment and the processing power required by the entity. The computer 100 may be a mobile device, tablet, smartphone or any sort of computing element with the above-listed elements. For example, a video corpus, such as a hard disk, solid state memory or storage device, might be stored in a distributed database system comprising multiple blade servers working together to provide the functionality described herein. The computers can lack some of the components described above, such as keyboards 110, graphics adapters 112, and displays 118.

Figure 2:
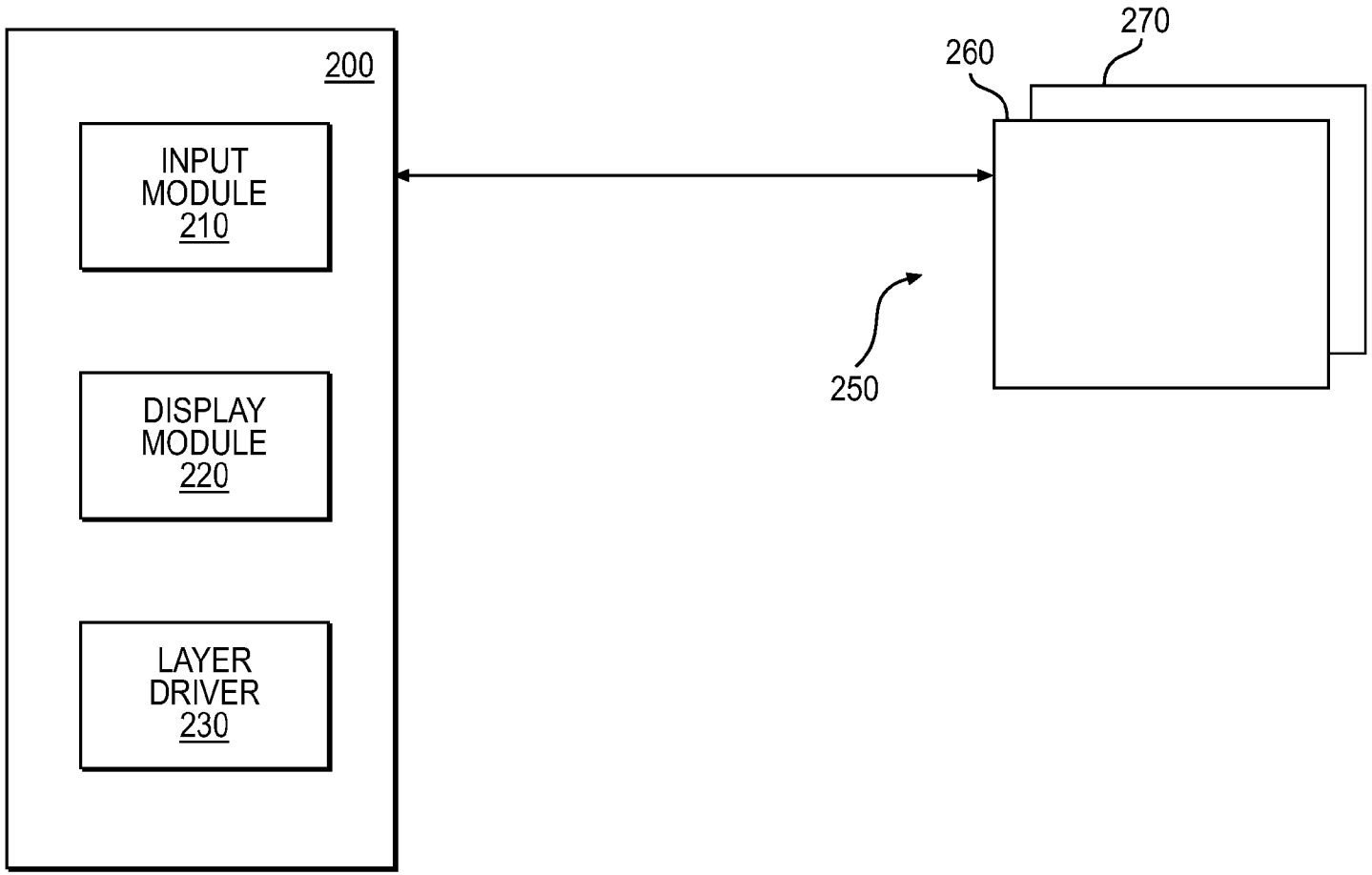
FIG. 2 illustrates an example of a system for driving a multi-layer transparent display.

FIG. 2 illustrates an example of a system 200 for driving a multi-layer transparent display 250. The system 200 may be incorporated as a device, such as computer 100. The system 200 includes an input module 210, a display module 220, and a layer driver 230. The system 200 may be employed at any location where the multi-layer transparent display 250 is situated at. For example, the system 200 may be implemented in a vehicle location (such as, near or around a dashboard of the vehicle).

The multi-layer transparent display 250 includes at least two displays (transparent display 260 and transparent display 270). For exemplary purposes, two displays are shown. However, one of ordinary skill in the art may implement system 200 with more than two displays. In one embodiment, as shown, the displays 260 and 270 overlap with each other. The overlapping may be an entire overlapping, or a partial overlapping.

The input module 210 communicates with various systems and sensors at the location that the multi-layer transparent display 250 is situated at. For example, if the multi-layer transparent display 250 is situated in a vehicle, the input module 210 may communicate with various modules associated with the vehicle, such as a speed control, engine control, outside environment sensor, user inputs, and the like. Any sort of module or sensor associated with the multi-transparent display 250 may be configured to communicate with the input module 210.

The input module 210 receives stimuli, such as various signals indicating that the multi-transparent display 250's various layers are requested to display content in a specific way. The input module 210 may be configured to instigate a special display based on a plurality of specific stimuli. Various examples will be discussed in further detail below.

The display module 220 receives the input from the input module 210, interfaces with the current display of the multi-transparent display 250, and determines a display for each individual layer. For example, if the input is a detection that the vehicle is approaching a dangerous road condition, the display module 220 may determine that the multi-layer transparent display 250 selectively display an image on a first layer (transparent layer 260), remove the image being displayed on the first layer (transparent layer 260), and then display an image on the second layer (transparent layer 270). This display may be repeated at a predetermined refresh rate. Thus, the effect of changing a display from a first layer to a second layer (in an animated fashion) may be effective at indicating to the vehicle's operator that a dangerous road condition should be carefully traversed.

The layer driver 230 receives the information from the display module 220, and individually drives each layer according to the instructed image determined by the display module 220. As discussed in the various examples below, the multi-layer transparent display 250 contains two layers, transparent display 260 and transparent display 270. However, one of ordinary skill in the art may implement the multi-layer transparent display 250 with more layers.

In one example of system 200, if the system 200 determines that a certain item is of greater priority, the system 200 may determine that the specific item (such as an indication, graphic, or icon), gets duplicated on multiple layers and or is represented in a unique manner than can't be achieved by a single non transparent display. Thus, by the specific item being duplicated or altered on multiple layers, the specific item may be able to attract the attention of the viewer of the multi-layer transparent display 250 of that specific item with more success.

Figure 4A:
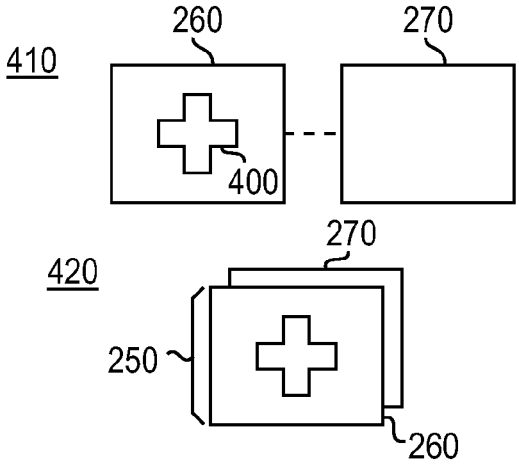
FIGS. 4A-4C illustrate examples of the embodiment of the system shown in FIG. 2.
Figure 4B:
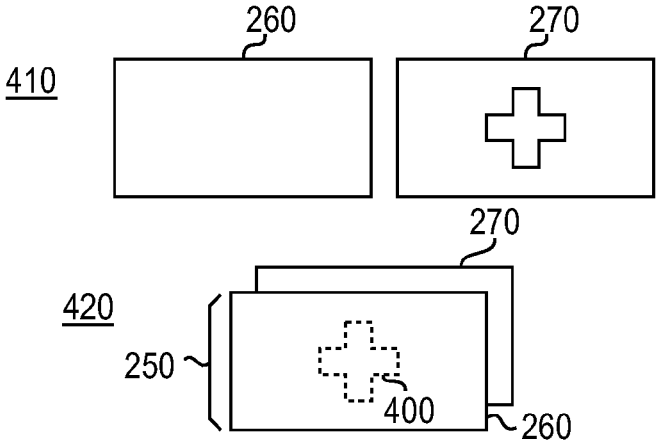
Figure 4C:
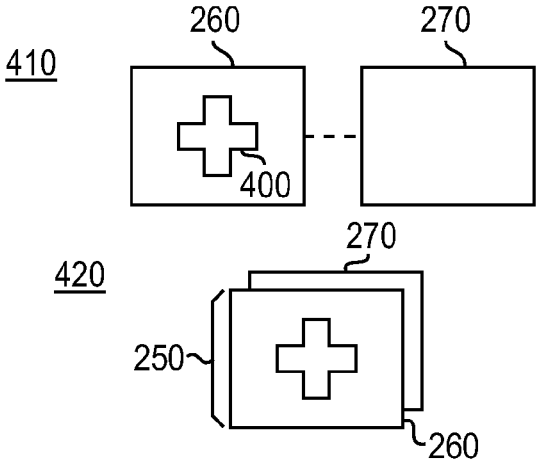

As shown in FIGS. 4(*a*)-(*c*), an example of the embodiment discussed above is shown. In all of FIGS. 4(*a*)-(*c*), a warning object 400 indicates a message to an observer of the display 250. In FIG. 4(*a*)-(*c*), a first view 410 of the displays 260 and 270 are individually presented. A second view 420 shows displays 260 and 270 overlapping each other.

In FIG. 4(*a*), the warning object 400 is driven to appear on display 260. The warning object 400 may be associated with any electronic implementation. For example, if the system 200 is implemented in a vehicle, the warning object 400 may be a hazard signal, or an indication that an object is approaching the vehicle.

In FIG. 4(*b*), the warning object 400 is driven to appear on display 270. Thus, by transitioning the warning object 400 from a first display 260, to a second display 270—the warning object 400 is presented in an animation-style. As shown in FIG. 4(*c*), the warning object 400 is now presented on display 260. The cycle shown in FIGS. 4(*a*)-4(*c*) may continue until the warning object 400 is no longer necessary, or alternatively, till an operator disables the presentation.

In another example of system 200, a user button may be provided (either on the multi-transparent display 250) or as an exterior input—that allows the user with ease to swap between viewing the contents of the various layers as the forefront layer. Thus, with the press of a single button, the content on the forefront layer (display 260) may be switched to the background layer (display 270).

Figure 5A:
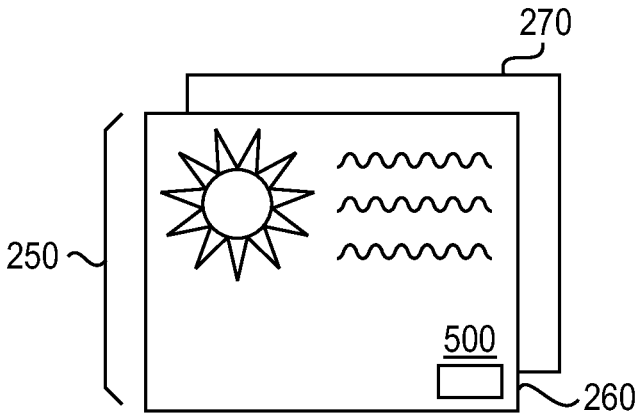
FIGS. 5A AND 5B illustrate examples of an embodiment of the system shown in FIG. 2.
Figure 5B:
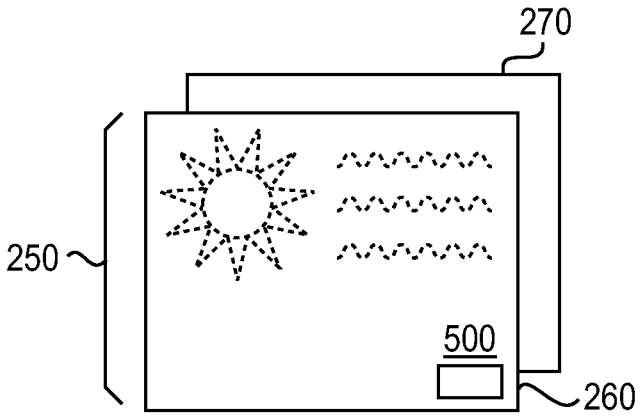

In FIG. 5(*a*), a select option 500 is presented on the display 260. Alternatively, the select button may be presented on or around an area associated with the multi-transparent display 250, such as a bezel or the like. In response to the user applying contact to the select option 500, the content on display 260 is switched to display 270 (as shown in FIG. 5(*b*)).

In another example of system 200, in response to an action being dynamically required, such as an incoming call, the system 200 may selectively present an alert message at the forefront layer of the multi-layer transparent display 250. Subsequently, once the action is no longer required, the system 200 may remove the alert.

In the above-described embodiments, the user may selectively configure the multi-layer transparent display 250 and system 200 to operate in a desired function. Thus, the user may selectively program or configure which elements of the multi-layer transparent display 250 employ multiple layers (or a single layer) dependent on the user's preferences or needs.

Thus, according to the aspects disclosed herein, a multi-layer transparent display 250 may be employed to selectively display various images on each layer to provide an animated, depth, enhanced user experience to the viewer of the multi-layer transparent display.

The system 200 may be used to promote a prominence function associated with the operation of the multi-layer transparent display 250. The prominence function essentially creates a ranking of the most relevant information to the least relevant information from information generated from a user/driver, a sensor, and other sources. The more relevant information is may be brought to the forefront where the front layer conveys critical information based on current or future conditions. The inputs are caused by the driver activating a function or requiring an update based on current and/or future condition.

The inputs to the multi-layer transparent display 250 may also be sourced from other sources, such as sensors or the like. Alerts may be critical and time sensitive. Alerts are either brought to the front layer and or also replicated on rear layers to attract the viewer of the multi-layer transparent display 250's attention; therefore, maximizing the time the viewer has to respond to a situation that generated the alert. Although the rear layer may display less relevant information, during an instance generated by the alert, the rear layer may assist by replicating the message or alert by duplication, different font size, color, blinking, etc.

The following examples indicated scenarios in which a prominence function may apply to the system disclosed herein.

1) Enlarging a speed on a gauge, moving the speed to the front layer to create depth of field affects;

2) Displaying warning indicators;

3) Activating blinker signals when a radio is on, the back and forth between changing the display via various layers capture a driver's attention;

4) Overlaying a text message, if a phone call is coming, bringing a phone menu to a front layer;

5) Hiding functions/overlay information as apposed having exposed all the time, e.g. for navigation information, such as points of interest, time to arrival, compass, etc. . .

6) Employing an interface with ultrasonic sensors and cameras, to point out objects or obstacles in a driver's path (arrows, squares, etc. . .) on one of the display layer and camera on the other; and 7) Overlaying warning masks on a front layer for side object detection with a side camera.

Figure 3:
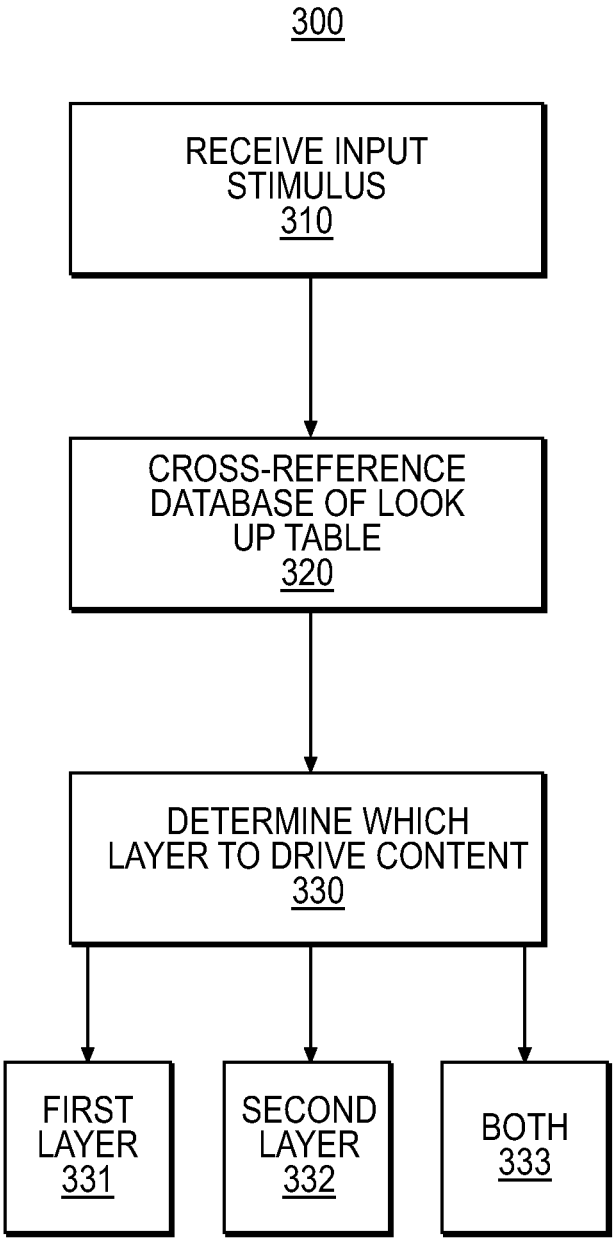
FIG. 3 illustrates an example implementation of a method for driving a multi-layer transparent display.

FIG. 3 illustrates a method 300 for driving a multi-layer transparent display. The method 300 may be implemented on a device, such as system 200. The multi-layer transparent display may be similar to the one described above in FIG. 2.

In operation 310, content to be displayed via the multi-transparent display is received. The content may be sourced from an affiliated electronic device, such as a computer associated with a vehicle.

In operation 320, a lookup table associated with the multi-transparent display is cross-referenced with, and based on a priority or a predetermined instruction, a decision is made as to which display of the multi-transparent display is to be driven. For example, if the multi-transparent display has two displays, a forefront display may be instructed to display content with a priority higher than the content currently being displayed.

In another example, as explained via FIG. 2, the content may be rotated or transitioned from each of the displays (thereby presenting an animated presentation).

In operation 330, the content is driven based on the information ascertained in operation 320. For example, the content may be presented on a first transparent display (331), a second transparent display (332), or both (333).

The method 300 may proceed back to operation 310 in response to an instruction being received via an affiliated electronic device.

Certain of the devices shown in FIG. 1 include a computing system. The computing system includes a processor (CPU) and a system bus that couples various system components including a system memory such as read only memory (ROM) and random access memory (RAM), to the processor. Other system memory may be available for use as well. The computing system may include more than one processor or a group or cluster of computing system networked together to provide greater processing capability. The system bus may be any of several types of bus structures including a memory bus or memory controller, a peripheral bus, and a local bus using any of a variety of bus architectures. A basic input/output (BIOS) stored in the ROM or the like, may provide basic routines that help to transfer information between elements within the computing system, such as during start-up. The computing system further includes data stores, which maintain a database according to known database management systems. The data stores may be embodied in many forms, such as a hard disk drive, a magnetic disk drive, an optical disk drive, tape drive, or another type of computer readable media which can store data that are accessible by the processor, such as magnetic cassettes, flash memory cards, digital versatile disks, cartridges, random access memories (RAMs) and, read only memory (ROM). The data stores may be connected to the system bus by a drive interface. The data stores provide nonvolatile storage of computer readable instructions, data structures, program modules and other data for the computing system.

To enable human (and in some instances, machine) user interaction, the computing system may include an input device, such as a microphone for speech and audio, a touch sensitive screen for gesture or graphical input, keyboard, mouse, motion input, and so forth. An output device can include one or more of a number of output mechanisms. In some instances, multimodal systems enable a user to provide multiple types of input to communicate with the computing system. A communications interface generally enables the computing device system to communicate with one or more other computing devices using various communication and network protocols.

Embodiments disclosed herein can be implemented in digital electronic circuitry, or in computer software, firmware, or hardware, including the herein disclosed structures and their equivalents. Some embodiments can be implemented as one or more computer programs, i.e., one or more modules of computer program instructions, encoded on a tangible computer storage medium for execution by one or more processors. A computer storage medium can be, or can be included in, a computer-readable storage device, a computer-readable storage substrate, or a random or serial access memory. The computer storage medium can also be, or can be included in, one or more separate tangible components or media such as multiple CDs, disks, or other storage devices. The computer storage medium does not include a transitory signal.

As used herein, the term processor encompasses all kinds of apparatus, devices, and machines for processing data, including by way of example a programmable processor, a computer, a system on a chip, or multiple ones, or combinations, of the foregoing. The processor can include special purpose logic circuitry, e.g., an FPGA (field programmable gate array) or an ASIC (application-specific integrated circuit). The processor also can include, in addition to hardware, code that creates an execution environment for the computer program in question, e.g., code that constitutes processor firmware, a protocol stack, a database management system, an operating system, a cross-platform runtime environment, a virtual machine, or a combination of one or more of them.

A computer program (also known as a program, module, engine, software, software application, script, or code) can be written in any form of programming language, including compiled or interpreted languages, declarative or procedural languages, and the program can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

To provide for interaction with an individual, the herein disclosed embodiments can be implemented using an interactive display, such as a graphical user interface (GUI). Such GUI's may include interactive features such as pop-up or pull-down menus or lists, selection tabs, scannable features, and other features that can receive human inputs.

The computing system disclosed herein can include clients and servers. A client and server are generally remote from each other and typically interact through a communications network. The relationship of client and server arises by virtue of computer programs running on the respective computers and having a client-server relationship to each other. In some embodiments, a server transmits data (e.g., an HTML page) to a client device (e.g., for purposes of displaying data to and receiving user input from a user interacting with the client device). Data generated at the client device (e.g., a result of the user interaction) can be received from the client device at the server.

I claim:

1. A method for driving a multi-layer transparent display, the multi-transparent display, implemented in a vehicle's instrument cluster, including a first transparent display layer and a second transparent display layer, comprising:

receiving a stimulus to present content via the multi-transparent display;

determine whether the content is presented via the first transparent display layer or the second transparent display layer; and detecting a dangerous road condition via a forward looking sensor;

switching whether the content is displayed via the first transparent display layer or the second transparent display layer in response to a condition, the condition being defined as an indication that the vehicle is approaching the detected dangerous road condition;

wherein the switching further comprises repeatedly switching the content from the first transparent display layer to the second transparent display layer, and vice-versa, until an indication is received to stop the switching.

2. The method according to claim 1, wherein the determination further comprises, determining whether the content is presented via the first transparent display layer or the second transparent display layer based on a lookup table, and the lookup table includes a corresponding priority associated with the content.

3. The method according to claim 1, wherein the switching further comprises, switching the content via the first transparent display layer and the second transparent display layer at a predetermined rate.

4. The method according to claim 1, wherein in response to engaging a selection option, switching the content presentation from the first transparent layer and the second transparent layer.

5. The method according to claim 1, wherein the first transparent layer and the second transparent layer overlap each other.

6. The method according to claim 5, wherein the multi-transparent layer is embedded in an automobile.

7. The method according to claim 6, wherein at least one of the first transparent layer or the second transparent layer is capable of touch-based detection.

8. The method according to claim 7, wherein in response to a second content item being received by the input module, determining whether the second content item's priority is higher or lower than the content, and displaying the second content item via the first or second transparent layer based on the determination.

* * * * *